US009301033B2

(12) United States Patent
Han et al.

(10) Patent No.: US 9,301,033 B2
(45) Date of Patent: Mar. 29, 2016

(54) DIRECTIONAL MICROPHONE AND OPERATING METHOD THEREOF

(71) Applicants: Hyundai Motor Company, Seoul (KR); BSE CO., LTD., Incheon (KR)

(72) Inventors: Mi Su Han, Goyang-si (KR); Young Soo Kim, Yongin-si (KR); Jeong Min Kim, Suwon-si (KR); Jung Min Kim, Incheon (KR); Myung Jin Lee, Busan (KR)

(73) Assignees: HYUNDAI MOTOR COMPANY, Seoul (KR); BSE CO., LTD., Incheon (KR)

( * ) Notice: Subject to any disclaimer, the term of this patent is extended or adjusted under 35 U.S.C. 154(b) by 172 days.

(21) Appl. No.: 14/051,897

(22) Filed: Oct. 11, 2013

(65) Prior Publication Data

US 2014/0355784 A1 Dec. 4, 2014

(30) Foreign Application Priority Data

May 29, 2013 (KR) ..... 10-2013-0060934

(51) Int. Cl.

| | |
|---|---|
| ***H04R 1/00*** | (2006.01) |
| ***H04R 1/40*** | (2006.01) |
| *H04R 3/00* | (2006.01) |
| *H04R 19/00* | (2006.01) |

(52) U.S. Cl.

CPC ..... *H04R 1/00* (2013.01); *H04R 1/406* (2013.01); *H04R 3/005* (2013.01); *H04R 19/005* (2013.01); *H04R 2430/20* (2013.01); *H04R 2499/13* (2013.01)

(58) Field of Classification Search

None

See application file for complete search history.

(56) References Cited

U.S. PATENT DOCUMENTS

| | | | | |
|---|---|---|---|---|
| 8,958,592 | B2 * | 2/2015 | Huang et al. | 381/351 |
| 2007/0057602 | A1 * | 3/2007 | Song | 310/328 |
| 2009/0074222 | A1 * | 3/2009 | Song | 381/357 |
| 2009/0161894 | A1 * | 6/2009 | Kimura | 381/174 |
| 2010/0226507 | A1 * | 9/2010 | Horibe et al. | 381/92 |
| 2010/0303273 | A1 | 12/2010 | Sawada | |
| 2013/0070951 | A1 * | 3/2013 | Tanaka et al. | 381/361 |

FOREIGN PATENT DOCUMENTS

| | | | |
|---|---|---|---|
| JP | 2008-092183 | A | 4/2008 |
| JP | 2010-136406 | A | 6/2010 |
| JP | 2010-283418 | A | 12/2010 |
| KR | 10-2007-0031512 | A | 3/2007 |
| KR | 10-2011-0137559 | A | 12/2011 |

* cited by examiner

*Primary Examiner* — Paul Huber

(74) *Attorney, Agent, or Firm* — McDermott Will & Emery LLP

(57) ABSTRACT

A directional microphone and an operating method thereof include a first signal generator generating a first sound signal corresponding to a front sound coming through a front sound hole of the directional microphone. A second signal generator generates a second sound signal corresponding to a rear sound coming through a rear sound hole of the directional microphone. A phase delay controller delays a phase of the rear sound coming through the rear sound hole, and a signal processor synthesizes the first sound signal and the second sound signal.

8 Claims, 6 Drawing Sheets

DIRECTIONAL MICROPHONE AND OPERATING METHOD THEREOF

CROSS-REFERENCE TO RELATED APPLICATION

This application claims the benefit of priority to Korean Patent Application No. 10-2013-0060934, filed on May 29, 2013 in the Korean Intellectual Property Office, the disclosure of which is incorporated herein in its entirety by reference.

TECHNICAL FIELD

The present disclosure relates to a directional microphone and an operating method thereof, and more particularly, to a Micro Electro Mechanical Systems (MEMS) microphone with improved directional property and an operating method thereof.

BACKGROUND

In the related art, in order to implement a directional property using MEMS microphones, two MEMS microphones and a digital signal processor (DSP) have been used.

That is, signals from the two MEMS microphones have been inverted using the digital signal processor, or a group delay for the signals from the two MEMS microphones has been implemented using the digital signal processor.

The above manner requires two MEMS microphones and a digital signal processor, thus increasing cost and power consumption by the digital signal processor.

SUMMARY

An aspect of the present disclosure provides a directional MEMS microphone used for recognizing telephone speeches and voices in a vehicle, and an operating method thereof.

Another aspect of the present disclosure provides a directional microphone capable of implementing a directional property using a single MEMS microphone without a separate digital signal processor, and an operating method thereof.

According to an aspect of the present disclosure, a directional microphone includes a first signal generator generating a first sound signal corresponding to a front sound coming through a front sound hole of the directional microphone. A second signal generator generates a second sound signal corresponding to a rear sound coming through a rear sound hole of the directional microphone. A phase delay controller delays a phase of the second sound signal generated by the second signal generator. A signal processor synthesizes the first sound signal and the phase-delayed second sound signal. The second sound signal and the first sound is signal may be in antiphase.

The phase delay controller may delay the phase of the second sound signal generated by the second signal generator based on a distance between the front sound hole and the rear sound hole.

The phase delay controller may delay the phase of the second sound signal until the first sound signal is generated by the first signal generator.

According to another aspect of the present disclosure, a directional microphone includes a board having a front sound hole and a rear sound hole formed thereon. A case having an open side is coupled with the board on the open side so as to form space therein. First and second MEMS dies are disposed on the board in the space of the case and convert sound sources coming through the respective holes into electric signals. A sound insulating wall has a top bonded to the case and a bottom bonded to the board so as to separate the first MEMS die from the second MEMS die. A filter is disposed in the space of the case with a bottom of which faces the rear sound hole and parts of both sides of which are bonded to the board so as to delay a phase of the rear sound coming through the rear sound hole. An application specific integrated circuit (ASIC) semiconductor chip disposed on the board, is electrically connected to the first MEMS die and the second MEMS die, and synthesizes two electrical signals each generated by the first and second MEMS dies, respectively.

The first and second MEMS dies may be spaced apart from each other by a predetermined distance.

The bottom of the first MEMS die may face the front sound hole. The front sound coming through the front sound hole may reach the bottom of the first MEMS die, and the rear sound passing through the filter may reach the top of the second MEMS die.

The filter may be made of a metal mesh or a fiber mesh. The filter may delay the phase of the rear sound depending on the porosity of the mesh.

The front and rear sound holes may vertically penetrate through the board.

The front sound hole may vertically penetrate through the board, and the rear sound hole may pass through the board with a horizontally bent shape. A length of the bending path of the rear sound hole may be adjusted based on a distance between the front sound hole and the rear sound hole.

In an aspect of the present disclosure, an operating method of a directional microphone includes: generating a second sound signal corresponding to a rear sound coming through a rear sound hole of the directional microphone, delaying a phase of the second sound signal, generating a first sound signal having an opposite phase with the second sound signal in response to a front sound coming through a front sound hole of the directional microphone, and synthesizing the first sound signal and the phase-delayed second sound signal to output an output signal.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, embodiments of the present disclosure will be described with reference to the accompanying drawings.

Figure 1:
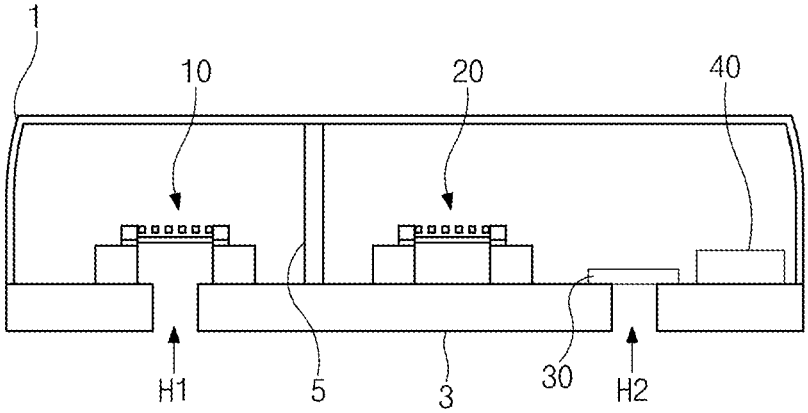
FIG. 1 is a diagram showing the configuration of a directional microphone according to an embodiment of the present disclosure.

FIG. 1 is a diagram showing the configuration of a directional microphone according to an embodiment of the present disclosure. Referring to FIG. 1, the directional microphone includes a printed circuit board (PCB) 3, a case 1, a first MEMS die 10, a second MEMS die 20, a sound insulating wall 5, a filter 30, and an application specific integrated circuit (ASIC) semiconductor chip 40.

Here, the board 3 includes a front sound hole H1 through which sound comes from the front and a rear sound hole H2 through which sound comes from the rear. The front and rear sound holes H1 and H2 vertically penetrate through to the board 3.

The case 1 has an open side and is coupled with the board 3 on the open side so as to form space therein. For instance, the case 1 is coupled with the board 3 on the open side with a groove therein, thereby forming a space in the groove.

The first and second MEMS dies 10 and 20 convert a received sound source is into an electrical signal. The dies are spaced apart from each other on the board 3 in the space of the case 1 by a predetermined distance.

The first MEMS die 10 faces the front sound hole H1 and converts a front sound coming through the front sound hole H1 into a first sound signal. The second MEMS die 20 converts a rear sound that is coming through the rear sound hole H2 and passing through the filter 30 into a second sound signal. The front sound coming through the front sound hole H1 reaches the bottom of the first MEMS die 10, whereas the rear sound coming through the rear sound hole H2 and passing through the filter 30 reaches the top of the second MEMS die 20

Since each of the front sound and the rear sound reaches the first MEMS die 10 and the second MEMS die 20 in the opposite direction, respectively, the first sound signal generated by the first MEMS die 10 and the second sound signal generated by the second MEMS die 20 have antiphases.

In order to prevent interferences between the front sound coming through the first MEMS die 10 and the rear sound coming through the second MEMS die 20 and between the first sound signal generated by the first MEMS die 10 and the second sound signal generated by the second MEMS die 20, the sound insulating wall 5 is disposed between the first MEMS die 10 and the second MEMS die 20. The top of the sound insulating wall 5 is bonded to the case 1 and the bottom is bonded to the board 3, such that the first MEMS die 10 and the second MEMS die 20 are to separated.

The filter 30 faces the rear sound hole H2 and each end side of the filter 30 is bonded to the board 3. The rear sound coming through the rear sound hole H2 passes through the filter 30 so that noise in the rear sound is removed by the filter 30.

Further, when the rear sound reaches the rear sound hole H2 before the front sound reaches the front sound hole H1, the filter 30 delays a phase of the rear sound. The filter 30 delays the phase of the rear sound until the front sound comes through the front sound hole H1. For example, the filter 30 delays the phase of the rear sound based on the distance between the front sound hole H1 and the rear sound hole H2. The detailed structure of the filter 30 will be described with reference to FIG. 3.

The semiconductor chip ASIC 40 is disposed on the board 3 and electrically connected to the first and second MEMS dies 10 and 20 so as to supply power thereto. The semiconductor chip synthesizes two electric signals, the first and second sound signals generated by the first and second MEMS dies 10 and 20, respectively. The second sound signal, which is corresponding to the rear sound, and the first sound signal are in antiphase. The second sound signal is removed from an output signal when the first and second sound signals are synthesized.

Figure 2:
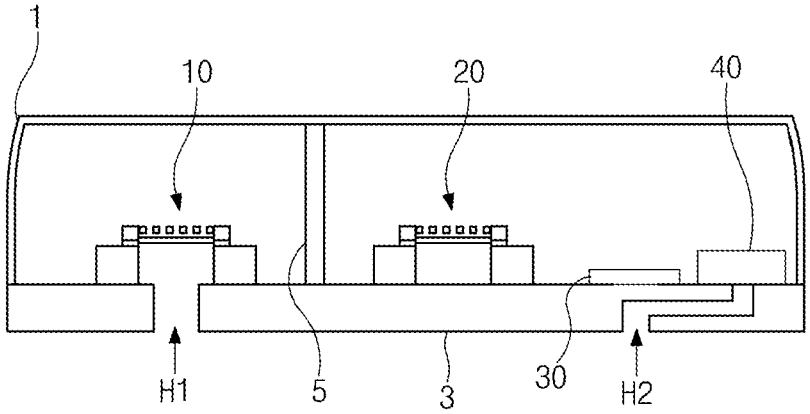
FIG. 2 is a diagram showing the configuration of a directional microphone according to another embodiment of the present disclosure.

FIG. 2 is a diagram showing the configuration of a directional microphone according to another embodiment of the present disclosure. FIG. 2 is identical to the FIG. 1 except for the shape of a rear sound hole H2. Therefore, the description on the same elements will be omitted.

The rear hole H2 in FIG. 1 vertically penetrates through the board 3. Referring to FIG. 2, in contrast, only the front sound hole H1 vertically penetrates through the board 3 whereas the rear sound hole H2 passes through the board 3 with a horizontally bent shape.

The phase of the rear sound may be delayed by adjusting the length of the bending path of the rear sound hole H2 based on the distance between the front sound hole H1 and the rear sound hole H2.

Figure 3:
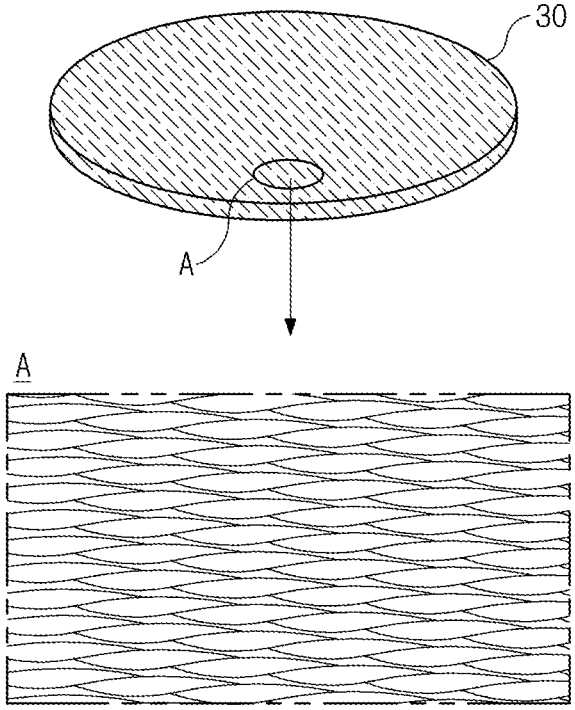
FIG. 3 is a diagram showing the structure of a filter employed by the present disclosure.

FIG. 3 is a diagram showing the structure of a filter employed by the present disclosure. As shown in FIG. 3, the filter may have a mesh structure, such as metal mesh or fiber mesh, in order to delay the rear sound.

The filter delays the phase of the rear sound based on the distance between the front sound hole and the rear sound hole. In this case, the filter delays the phase of the rear sound depending on the porosity of the mesh.

The filter is not limited to a mesh structure but may be defined by weaving a metal thread or a fiber.

Figure 4:
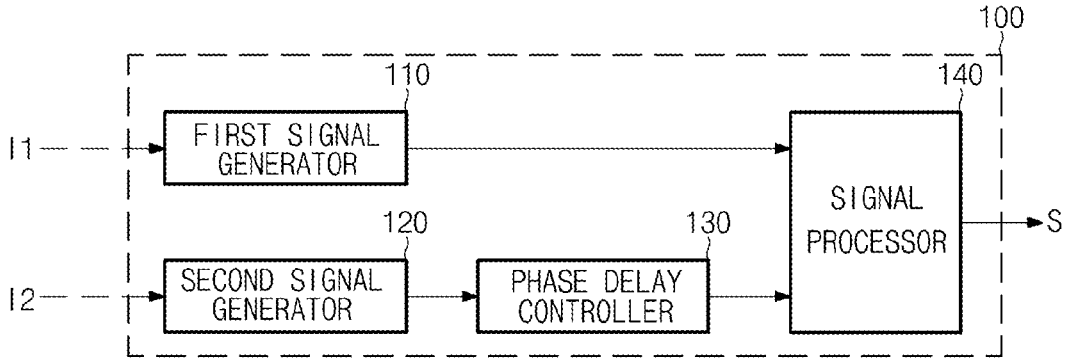
FIG. 4 is a block diagram illustrating the configuration of a directional microphone according to an embodiment of the present disclosure.
Figure 5:
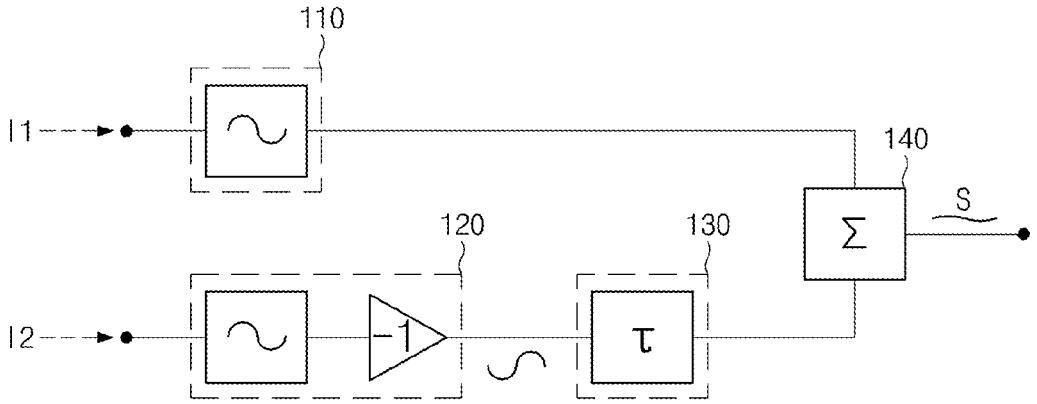
FIG. 5 is circuit diagram for illustrating the operation of the microphone of FIG. 4.

FIG. 4 is a block diagram illustrating the configuration of a directional microphone according to an embodiment of the present disclosure, and FIG. 5 is a circuit diagram illustrating the operation of the microphone in FIG. 4. Referring to FIGS. 4 and 5, the directional microphone 100 includes a first signal generator 110, a second signal generator 120, a phase delay controller 130, and a signal processor 140.

The first signal generator 110 generates a first sound signal in response to a front sound coming through a front sound hole formed in a board of the directional microphone 100. The second signal generator 120 generates a second sound signal in response to a rear sound coming through a rear sound hole formed in the board of the directional microphone 100. Here, the second sound signal and the first sound signal are in antiphase.

The phase delay controller 130 delays the phase of the second sound signal generated by the second signal generator 120 when the rear sound comes through the rear sound hole before the front sound comes through the front hole. In this case, the phase delay controller 130 delays the phase of the second sound signal so that the first and second sound signals reach the signal processor 140 is simultaneously.

For example, the phase delay controller 130 may delay the phase of the second sound signal based on the distance between the front sound hole and the rear sound hole. Further, the phase delay controller 130 may delay the phase of the second sound signal until the first sound signal is generated by the first signal generator 110.

The signal processor 140 synthesizes the first and second signals to output a final sound signal. Here, the second sound signal and the first sound signal are in antiphase. The second sound signal corresponding to the rear sound is removed when the first and second sound signals are synthesized.

An operational flow of the directional microphone according to the embodiment of the present disclosure will be described below in detail.

Figure 6:
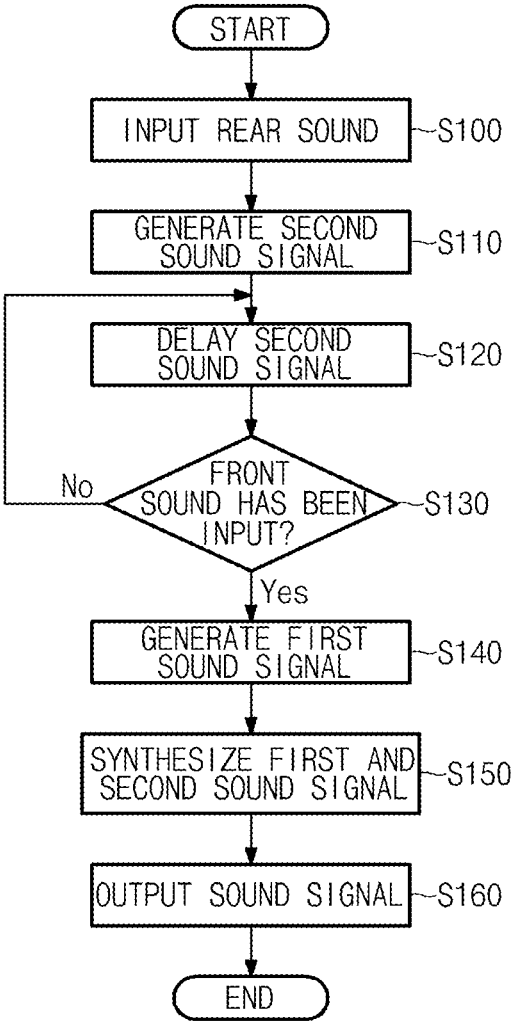
FIG. 6 is a flow chart illustrating an operational flow of a directional microphone according to an embodiment of the present disclosure.

FIG. 6 is a flow chart illustrating an operational flow of a directional microphone according to an embodiment of the present disclosure. As shown in FIG. 6, when a rear sound reaches a second MEMS die of the directional microphone (S100), the second MEMS die of the directional microphone generates a second sound signal corresponding to the rear sound (S110). The filter of the directional microphone delays the phase of the second sound signal (S120). Here, the filter may delay the phase of the second sound signal until the first sound signal corresponding to the front sound is generated.

Then, when a front sound reaches the first MEMS die in the opposite direction to that of the rear sound (S130), the first MEMS die of the directional microphone generates the first sound signal corresponding to the first MEMS die (S140). Since the front sound signal comes in the opposite direction to that of the rear signal, the first sound signal and the second sound signal are in antiphase.

An ASIC disposed on the board of the directional microphone synthesizes the first sound signal generated by the first MEMS die and the second sound signal generated by the second MEMS die. The phase of the second sound signal is delayed by the filter (S150), and the second sound signal is removed corresponding to the rear sound. Subsequently, the semiconductor chip outputs a final sound signal from which the second sound signal has been removed (S160).

As stated above, by replacing a single MEMS microphone with two MEMS microphones and a digital signal processor to implement directional property, a reduction in cost can be achieved and power consumption can be minimized.

Further, by employing a filter for delaying the phase of a signal from a directional MEMS microphone, noise can be removed, thereby improving telephone speech quality and voice recognition efficiency.

Although the directional microphone and the operating method thereof according to the embodiments of the present disclosure have been described with reference to the accompanying drawings, the present disclosure is limited neither by the embodiments nor by the accompanying drawings disclosed in the present specification, but may be modified without departing from the scope and spirit of the present disclosure.

What is claimed is:

1. A directional microphone, comprising:

a board having a front sound hole and a rear sound hole formed therein;

a case having an open side and being coupled with the board on the open side so as to define a space therein;

first and second Micro Electro Mechanical Systems (MEMS) dies disposed on the board in the space of the case and converting sound sources coming through the respective holes into electric signals;

a sound insulating wall having a top bonded to the case and a bottom bonded to the board so as to separate the first MEMS die from the second MEMS die;

a filter disposed in the space in the case, a bottom of which faces the rear sound hole and parts of both sides of which are bonded to the board so as to delay a phase of a rear sound coming through the rear sound hole; and an application specific integrated circuit (ASIC) semiconductor chip disposed on the board, electrically connected to the first MEMS die and the second MEMS die, and synthesizing two electrical signals each generated by the first and second MEMS dies, respectively, wherein a front sound coming through the front sound hole reaches the bottom of the first MEMS die, and the rear sound passing through the filter reaches a top of the second MEMS die.

2. The microphone according to claim 1, wherein the first and second MEMS dies are spaced apart from each other by a predetermined distance.

3. The microphone according to claim 1, wherein a bottom of the first MEMS die faces the front sound hole.

4. The microphone according to claim 1, wherein the filter is made of a metal mesh or a fiber mesh.

5. The microphone according to claim 4, wherein the filter delays the phase of the rear sound depending on a porosity of the mesh.

6. The microphone according to claim 1, wherein the front and rear sound holes vertically penetrate through the board.

7. The microphone according to claim 1, wherein the front sound hole vertically penetrates through the board, and wherein the rear sound hole passes through the board with a horizontally bent shape.

8. The microphone according to claim 1, wherein a length of a bending path of the rear sound hole is adjusted based on a distance between the front sound hole and the rear sound hole.

* * * * *